United States Patent [19]

Adelberger et al.

[11] 4,160,572

[45] Jul. 10, 1979

[54] CONNECTOR HOUSING

[75] Inventors: Donald L. Adelberger, Dayton; William Pangos, Centerville, both of Ohio

[73] Assignee: NCR Corporation, Dayton, Ohio

[21] Appl. No.: 861,318

[22] Filed: Dec. 16, 1977

[51] Int. Cl.[2] ..... H01R 3/06

[52] U.S. Cl. ..... 339/14 P; 339/103 M

[58] Field of Search ..... 339/14 R, 14 P, 18 P, 339/47 R, 49 R, 49 B, 103, 104, 176 M, 176 P, 176 R, 217 R

[56] References Cited

U.S. PATENT DOCUMENTS

| | | | |
|---|---|---|---|
| 3,874,765 | 4/1975 | Gilmore et al. | 339/103 M |
| 3,920,306 | 11/1975 | Barnett, Jr. et al. | 339/103 M |

*Primary Examiner*—Roy Lake

*Assistant Examiner*—DeWalden W. Jones

*Attorney, Agent, or Firm*—J. T. Cavender; Albert L. Sessler, Jr.; Elmer Wargo

[57] ABSTRACT

A connector housing which is formed of first and second sections which are shaped to form a hollow housing having a cable insert end and a connector opening when in assembled relationship. Cable clamps are used to secure a cable in the cable insert end and to secure the first and second sections together. A multi-pin connector operatively connected to the cable is mounted in the connector opening so as to provide a free-floating connection with a mating connector. The housing may also provide a shielded connection between a utilization device having a mating connector or an identical connector housing having the mating conductor therein to provide a shielded cable-to-cable connection.

15 Claims, 14 Drawing Figures

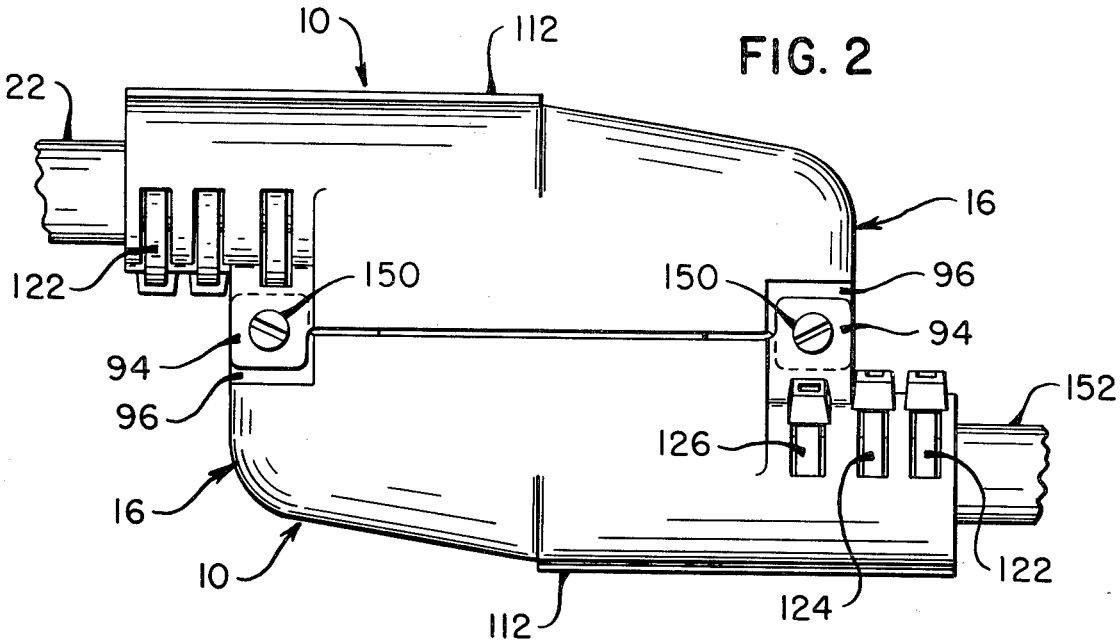
FIG. 2
FIG. 1
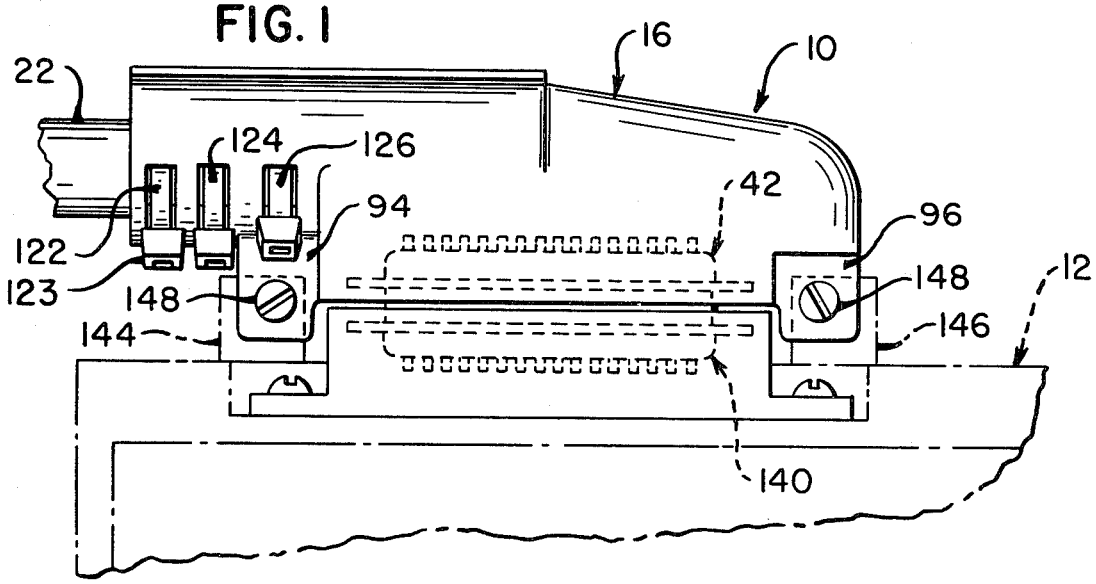
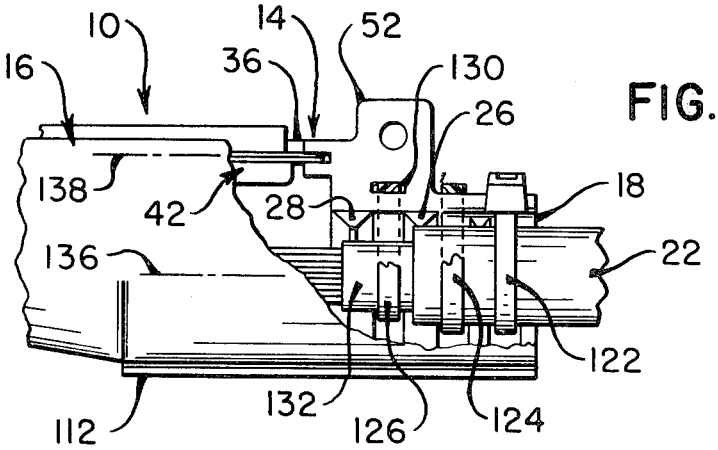
FIG. 3

FIG. 4
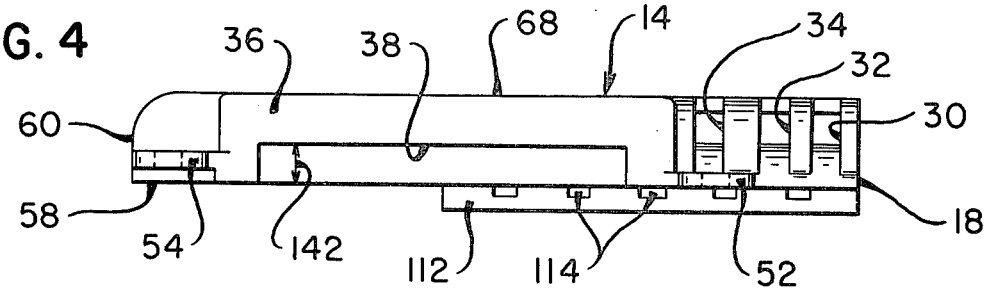
FIG. 5
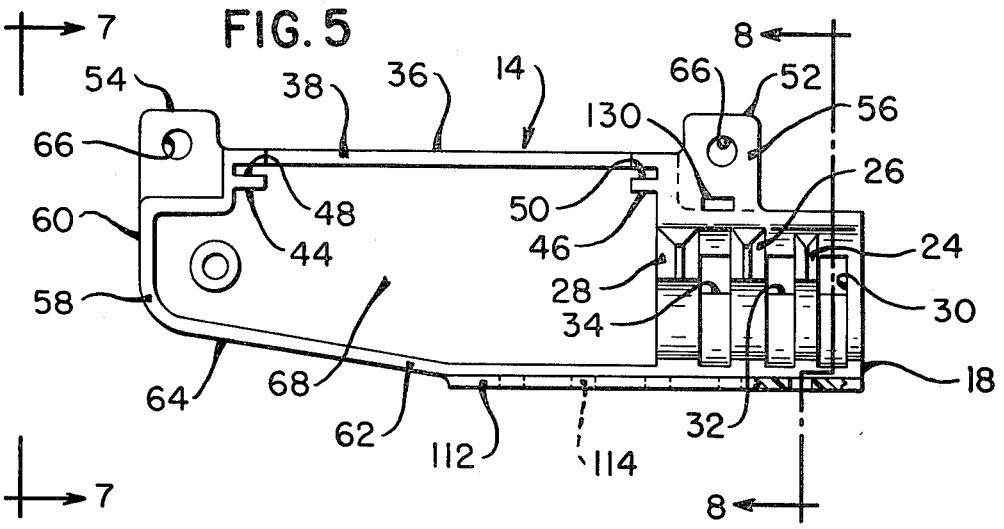
FIG. 6
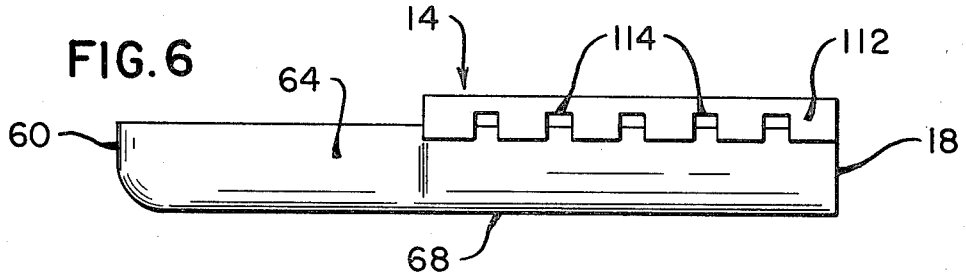
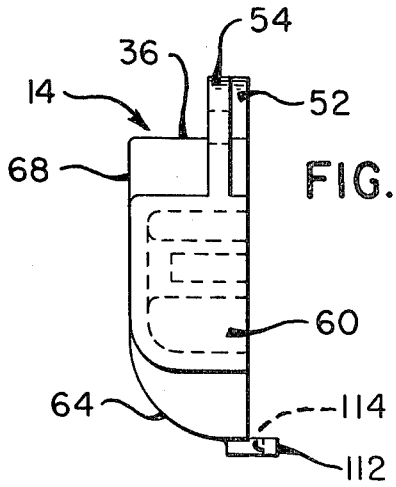
FIG. 7
FIG. 8
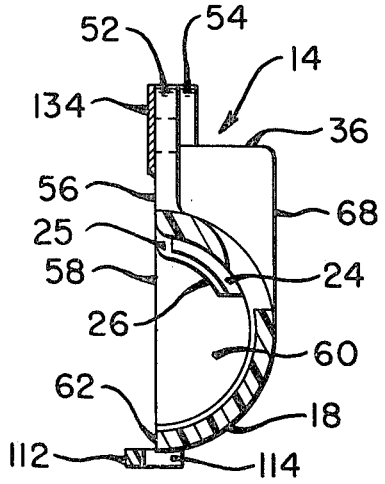

CONNECTOR HOUSING

BACKGROUND OF THE INVENTION

This invention relates to a connector housing which may be used to interface a cable to a terminal or to another cable, and may also be used to provide a shielded connection therebetween.

In certain business machines, it is necessary to connect a multi-wire cable to a connector on the machine or terminal in such a way as to provide strain relief for the cable and a free-floating connection with the connector on the terminal. In some situations, it is also necessary to provide electrostatic shielding between the cable and the connector on the terminal in a way that is both efficient and pleasing in appearance. In other situations it is necessary that a cable-to-cable connection be effected while providing electrostatic shielding therebetween.

The present invention satisfies the above requirements.

SUMMARY OF THE INVENTION

This invention relates to a connector housing which includes first and second sections and means enabling the first and second sections to be formed into the housing. The first and second sections are shaped to form a cable insert end and a connector opening when formed into the housing. Means are provided for securing a cable in the cable insert end and retaining means located in at least one of the first and second sections enable a connector to be retained in the housing at the connector opening.

In a preferred embodiment of the invention, the housing provides electrostatic shielding for the cable and a mating connector on the terminal for a cable-to-terminal connection or for the cable and a mating connector on a second cable for a cable-to-cable connection.

For a cable-to-terminal connection, the following advantages are obtained by the connector housing of this invention:

(a) Electrostatic shielding of the connector;
(b) Strain relief of the cable at the housing;
(c) Grounding of the shielded cable to the housing;
(d) Grounding of the housing to the terminal;
(e) Mechanical attachment of the housing to the terminal; and
(f) Self alignment and/or free floating of the connector in the housing to the mating conductor on the terminal.

For a cable-to-cable connection, the following advantages are obtained by the connector housing of this invention:

(a) Electrostatic shielding of the connectors;
(b) Strain relief of the cables to the housings;
(c) Grounding of each shielded cable to its associated housing;
(d) Grounding of the housing to the mating housing;
(e) Mechanical attachment of one housing to the mating housing; and
(f) Self alignment and/or free floating of one connector to the mating connector.

These advantages and others will become more readily understood in connection with the following specification, claims, and drawing.

BRIEF DESCRIPTION OF THE DRAWING

FIG. 1 is a general plan view of a preferred embodiment of this invention showing how the connector housing provides a cable-to-terminal connection;

FIG. 2 is a general plan view of the connector housing as used to provide a cable-to-cable connection;

FIG. 3 is a side view of the connector housing, partially broken away to show the means for securing the cable at the cable insert end of the connector housing; the outer plastic jacket of the cable is stripped back to expose the grounding sheath thereof;

FIG. 4 is a top view of the first section of the connector housing;

FIG. 5 is a side view of the first section shown in FIG. 4;

FIG. 6 is a bottom view of the first section shown in FIG. 4;

FIG. 7 is an end view of the first section as seen from the line 7—7 of FIG. 5;

FIG. 8 is a cross-sectional view of the first section as taken along the line 8—8 of FIG. 5;

DETAILED DESCRIPTION OF THE INVENTION

Figure 9:
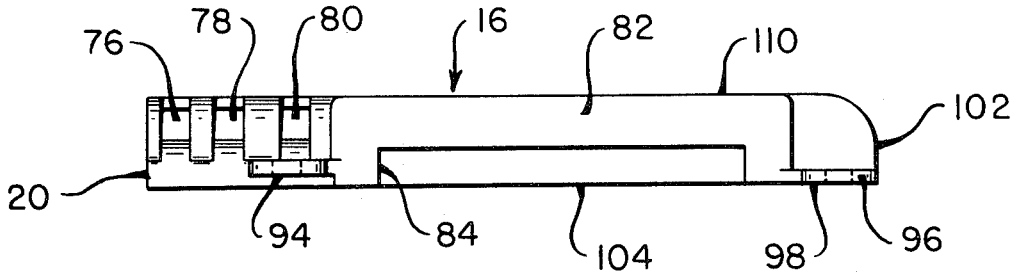
FIG. 9 is a top view of the second section of the connector housing.

FIG. 1 is a plan view of a preferred embodiment of this invention showing how the connector housing designated generally as 10 is operatively connected to a business machine or terminal 12, shown in phantom outline, to provide the cable-to-terminal connection mentioned earlier herein. The connector housing 10 is comprised of a first section 14 and a second section 16 and has means enabling the first and second sections (14, 16) to be assembled or formed into the housing shown in FIG. 1, for example.

The first section 14 is best shown in FIGS. 4–8; it has a cable insert end 18 which is both semi-circular and cylindrical in shape and cooperates with the cable insert end 20 of the second section 16 to receive the cable 22. The cable insert end 18 has a securing area at which the arcuately-shaped ribs 24, 26, and 28 are formed. The rib 24 does not extend to the plane of edge 56 to provide a gap 25 as shown in FIG. 8. The cable insert end 18 also has openings 30, 32 and 34 formed therein as is best shown in FIGS. 4 and 5.

Figure 14:
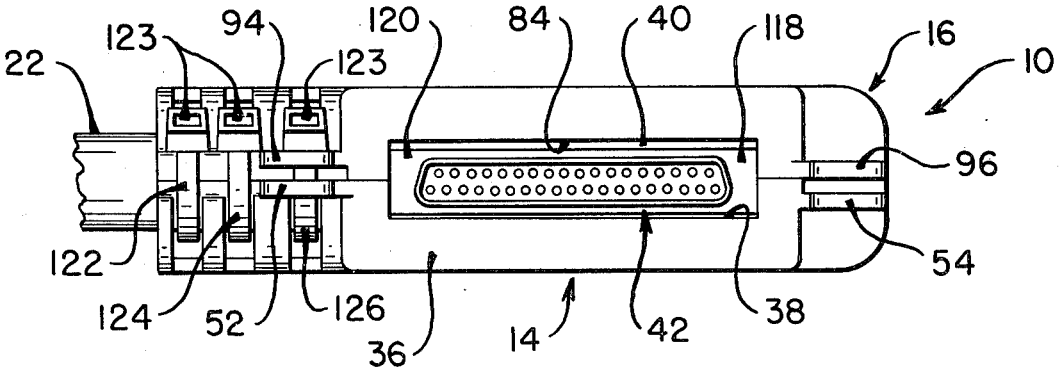
FIG. 14 is a plan view looking at the connector in the connector opening of an assembled connector housing.

The first section 14 also has a flat portion 36 which has a rectangular area removed therefrom to form an opening 38 which is part of the opening 40 in which the connector 42 is located as shown in FIG. 14. Areas 44 and 46 located on opposed sides of the opening 38 (FIG. 5) have recesses 48 and 50, respectively, formed therein to enable the connector 42 to be mounted therein in a free floating manner as will be described hereinafter.

The first section 14 has first and second lugs 52, 54 which extend therefrom as shown in FIG. 5. The inner face 56 of the first lug 52 lies in the same plane as the edge 58 of the end wall 60 and the edge 62 of the bottom wall 64, while the second lug 54 is slightly displaced therefrom as is best shown in FIG. 4. Suitable fastener mounting holes 66 are provided in the first and second lugs 52, 54. The first section 14 also has a back wall 68 which is integrally formed with the end wall 60, the flat portion 36, the bottom wall 64 and the cable insert end 18 to provide a continuous enclosure.

Figure 10:
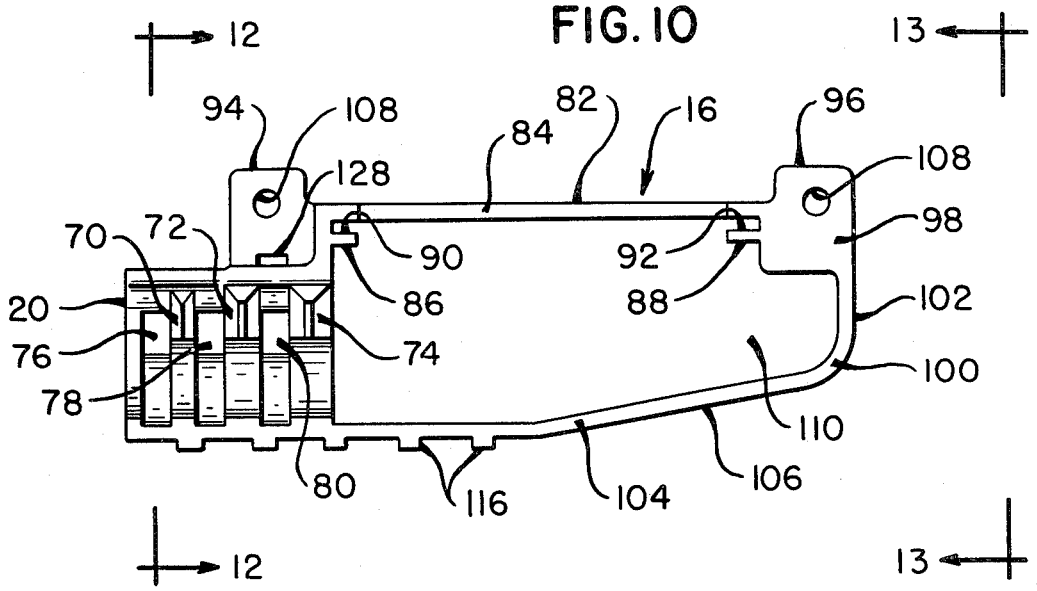
FIG. 10 is a side view of the second section shown in FIG. 9.
Figure 11:
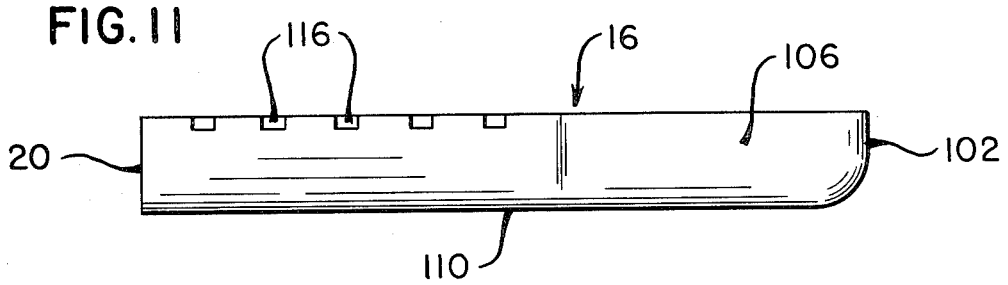
FIG. 11 is a bottom view of the second section shown in FIG. 9.
Figure 12:
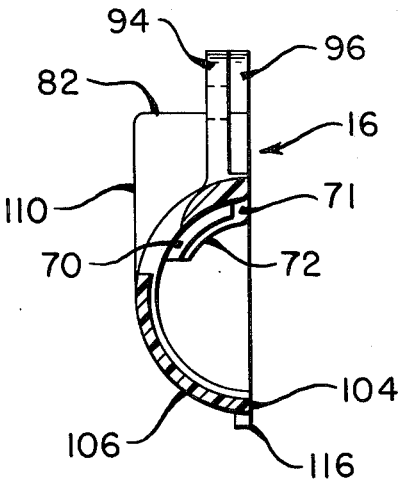
FIG. 12 is a cross-sectional view of the second section, taken along the line 12—12 of FIG. 10.
Figure 13:
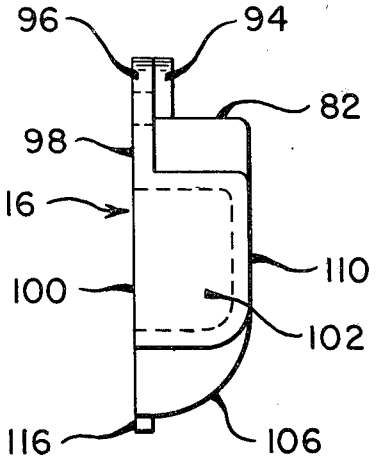
FIG. 13 is an end view of the second section, taken along the line 13—13 of FIG. 10.

The second section 16 is substantially similar to the first section 14; however, it is a "mirror image" or counterpart of the first section 14. The second section 16 is best shown in FIGS. 9–13; it has the cable insert end 20 which cooperates with the cable insert end 18 of the first section 14 to receive the cable 22 therein. The cable insert end 20 has a securing area at which the ribs 70, 72 and 74 are formed. The rib 70 does not extend to the plane of edge 104 to provide a gap 71 as shown in FIG. 12. The cable insert end 20 also has openings 76, 78 and 80 formed therein as is best shown in FIGS. 9 and 10.

The second section 16 also has a flat portion 82 which has a rectangular area removed therefrom to form an opening 84 which is part of the opening 40 in which the connector 42 is located, as shown in FIG. 14. Areas 86 and 88 located on opposed sides of the opening 84 (FIG. 10) have recesses 90 and 92, respectively, formed therein to enable the connector 42 to be mounted therein in a free-floating manner as will be described hereinafter.

The second section 16 has first and second lugs 94 and 96, respectively, which extend therefrom as shown in FIG. 10. The inner face 98 of the second lug 96 lies in the same plane as the edge 100 of the end wall 102, and the edge 104 of the bottom wall 106, while the first lug 94 is slightly displaced therefrom as is best shown in FIG. 9. Suitable fastener mounting holes 108 are provided in the first and second lugs 94, 96. The second section 16 also has a back wall 110 which is integrally formed with the end wall 102, the flat portion 82, the bottom wall 106 and the cable insert end 20 to provide a continuous enclosure.

The means enabling the first and second sections 14, 16 to be formed into connector housing 10 includes an extension 112 (located on the bottom wall 64 of the first section 14) having a plurality of aligned openings 114 therein as shown in FIG. 6, and also includes a plurality of mating aligned projections 116 which extend from the bottom wall 106 of the second section 16 as is best shown in FIGS. 10–13.

In order to assemble the connector housing 10, the first and second sections 14, 16 are aligned as shown in FIG. 14, and the projections 116 of the second section 16 are inserted into the complementary openings 114 of the first section 14 to pivotally connect these two sections together. Prior to closing the first and second sections 14, 16 together, the cable 22 with its associated connector 42 operatively connected therewith is laid within the housing 10, and the opposed mounting flanges 118 and 120 (FIG. 14) of the connector 42 are inserted into the recesses of the housing, with flange 118 being received by recess 92 of the second section 16 and recess 48 of the first section 14, and with flange 120 being received by recess 90 of the second section 16 and recess 50 of the first section 14. With the cable 22 and connector 42 within the connector housing 10, a first conventional clamp tie or band 122 is inserted through the opening 30 in the first section 14, around the cable 22, and out through the opening 76 in the second section 16. Thereafter, the band 122 may be pulled tightly and secured on the outside of the connector housing 10 via the conventional locking member 123 to secure the cable 22 against the ribs 24 and 70; a second band 124 may be similarly used by threading it through the associated openings 32 and 78. When the first and second bands 122, 124 are pulled tightly and secured, they force the outer plastic jacket of the cable 22 into the gaps 25 and 71 (FIGS. 8 and 12 respectively) to provide strain relief for the cable 22 and prevent it from rotating relative to the housing 10.

The third band 126 is inserted through the hole 128 (FIG. 10) in the lug 94 of the second section 16, the hole 130 of the lug 52 of the first section 14, the hole 34 of the first section 14, around the exposed grounding sheath 132 of the cable 22 (as shown in FIG. 3) and out of hole 80 of the second section 16. Thereafter the band 126 is pulled tightly and secured to force the grounding sheath 132 against the ribs 28 and 26 of the first section 14 and ribs 72 and 74 of the second section 16 to provide an electrical connection therebetween.

The first and second sections 14, 16 may be made of electrically conductive material such as cast aluminum or they may be conventionally molded of plastic material as shown, and covered with a continuous layer 134 (shown only diagrammatically in FIG. 8) of electrically conductive material such as plated copper, nickel and chrome to provide a conducting path between ribs such as 26 and 28, the interior of the housing 10 and the lugs such as 52, 54, 94 and 96. The ribs such as 28, 26, 72, and 74 depend closer to the longitudinal axis 136 (FIG. 3) of the cable 22 than do the ribs 24 and 70 to enable the grounding sheath 132 to be contacted when the protective cover or plastic jacket of the cable is removed to expose the grounding sheath 132. The plane of the connector 42 as represented by the dashed line 138 in FIG. 3 is parallel to the longitudinal axis 136 of the cable 22 when in the assembled relationship shown.

When the connector housing 10 is assembled as shown in FIG. 14, the connector 42 is free-floating in that it can be moved within the recesses such as 90, 92 to provide for some shifting when the connector 42 is to be connected to a mating connector 140 (FIG. 1). The recess 48 of the first section 14 is aligned with the recess 92 of the second section 16, and similarly, the recess 50 of the first section 14 is aligned with the recess 90 of the second section 15 when in the assembled relationship shown in FIG. 14. The flange 118 of the connector 42 has a width which is greater than the width of the opening 38, for example, as measured by the line 142 in FIG. 4 to thereby provide additional support by having the flange 118 extend into recesses 48 and 92; the same technique is used for the other flange 120 of the connector 42.

When the connector housing 10 provides a cable-to-terminal connection, the connector 42 is inserted in the mating connector 140 (FIG. 1) of the terminal 12 and the housing 10 is secured thereto by securing it to the apertured mounting lugs 144 and 146. The lugs 144 and 146 are electrically conducting and are displaced slightly with regard to each other to enable the lug 144 to be sandwiched between the lugs 52 and 94 of the connector housing 10, and similarly, to enable the lug 146 to be sandwiched between the lugs 54 and 96 of the connector housing 10 to thereby provide an electrostatic shield between the cable 22 and the terminal 12. Suitable fasteners 148 secure the connector housing 10 to the mounting lugs 144, 146.

When the housing connector 10 is used to provide a cable-to-cable connection as shown in FIG. 2, two identical housing connectors 10 may be used, with one of these connectors having the connector 42 therein and the other having the mating connector 140 therein. The mounting lug 96 of the second section 16 of the lower housing 10 shown in FIG. 2 is sandwiched between the mounting lugs 94 and 52 of the upper housing 10, and the mounting lug 96 of the second section 16 of the upper housing 10 is sandwiched between the mounting lugs 94 and 52 of the lower housing 10. Suitable fasteners 150, passing through the mounting lugs such as 94 and 96 secure both the upper and lower housings 10 (as viewed in FIG. 2) together to provide electrostatic shielding between cable 22 and cable 152.

While the first and second sections 14 and 16 are shown as discrete elements herein, they can be made from a unitary piece of plastic with an integrally formed hinge or "living hinge" connecting these sections together; however, the projections 116 fitting into the holes 114 form a more durable connection. The cable clamps or bands such as 122, 124 and 126 each may be a conventional cable clamps such as tie clamp PLT 2S-O which is manufactured by Panduit or tie clamp TY25M-X which is manufactured by Thomas and Betts. The connector 42 may be a conventional connector such as Amplimite High Density 20 Plug 205714 or 205859 manufactured by AMP Inc., and the mating connector 140 may also be a conventional connector such as Amplimite High Density 20 Receptacle 205209 manufactured by AMP Inc.

What is claimed is:

1. A connector housing comprising:

first and second sections;

means enabling said first and second sections to be assembled to form said housing;

said first and second sections being shaped to form a cable insert end and a connector opening when assembled to form said housing;

means for securing a cable in said cable insert end; and retaining means located in at least one of said first and second sections for enabling a connector to be retained in said housing at said connector opening;

said retaining means comprising first and second areas in at least one of said first and second sections; said first and second areas having recesses therein to enable said connector to be retained therein to also provide a free floating connection with a mating connector;

said securing means comprising a securing area in each of said first and second sections at said cable insert end of said housing;

each said securing area having an opening therein to enable a band to be passed through said openings and around said cable to secure said cable in said cable insert end;

said securing area in each of said first and second sections having a second opening therein; and said first and second sections having an electrically conductive surface on an interior side thereof to enable a second band to be passed through said second openings and around a grounding sheath on said cable to electrically connect said grounding sheath to said electrically conductive surface.

2. The connector housing as claimed in claim 1 in which said housing has connection means thereon which are electrically connected with said electrically conductive surface to provide a grounding connection to a utilization device when said connector housing is operatively connected thereto.

3. The connector housing as claimed in claim 2 in which said connection means comprise connection lugs which are located on each of said first and second sections to enable said connector housing to be optionally secured to said utilization device or to a second connector housing having said mating conductor therein, which said second connector housing is identical to said connector housing.

4. The connector housing as claimed in claim 3 in which said enabling means comprise:

an extension on said first section having a plurality of holes therein; and a plurality of projections on said second section interfitting with said plurality of holes to enable said first and second sections to pivot with respect to each other to form said housing; and in which said openings are located in said securing areas to enable said band to secure said first and second sections together in addition to securing said cable in said cable insert end.

5. A hollow connector housing comprising:

first and second sections;

means enabling said first and second sections to be hinged together to form said housing;

said first and second sections being shaped to form a cable insert end and a connector opening when formed into said housing;

said first and second sections each having a securing area therein with aligned openings therein to enable a band to be passed through said aligned openings and around a cable which is inserted in said cable insert end to secure said cable in said cable insert end and to also secure said first and second sections together when formed into said housing;

at least one of said first and second sections having recesses therein on opposed sides of said connector opening to enable a connector to be mounted in said recesses and retained in said housing so as to provide a free floating connection with a mating connector;

said first and second sections being made of an electrically conducting material;

said securing area in each of said first and second sections having a second opening therein; and said first and second sections having an electrically conductive surface on an interior side thereof to enable a second band to be passed through said second openings and around a grounding sheath on said cable to electrically connect said grounding sheath to said electrically conductive surface.

6. A hollow connector housing comprising:

first and second sections;

means enabling said first and second sections to be hinged together to form said housing;

said first and second sections being shaped to form a cable insert end and a connector opening when formed into said housing;

said first and second sections each having a securing area therein with aligned openings therein to enable a band to be passed through said aligned openings and around a cable which is inserted in said cable insert end to secure said cable in said cable insert end and to also secure said first and second sections together when formed into said housing;

at least one of said first and second sections having recesses therein on opposed sides of said connector opening to enable a connector to be mounted in said recesses and retained in said housing so as to provide a free floating connection with a mating connector;

said securing area in each of said first and second sections having a second opening therein; and said first and second sections having an electrically conductive surface on an interior side thereof to enable a second band to be passed through said second openings and around a grounding sheath on said cable to electrically connect said grounding sheath to said electrically conductive surface.

7. The connector housing as claimed in claim 6 in which said housing has connection means thereon which are electrically connected with said electrically conductive surface to provide a grounding connection to a utilization device when said connector housing is operatively connected thereto.

8. The connector housing as claimed in claim 7 in which said connection means comprise:

connection lugs which are located on each of said first and second sections to enable said connector housing to be optionally secured to said utilization device or to a second connector housing having said mating conductor therein, which said second connector housing is identical to said connector housing.

9. The connector housing as claimed in claim 8 in which said enabling means comprise:

an extension on said first section having a plurality of holes therein; and a plurality of projections on said second section interfitting with said plurality of holes to enable said first and second sections to hinge with respect to each other to form said housing.

10. The connector housing as claimed in claim 9 in which each of said first and second sections has said recesses located on opposed sides of said connector opening, with said recesses in said first and second sections lying in a common plane to receive opposed mounting flanges of said connector.

11. The connector housing as claimed in claim 10 in which said first and second sections have portions removed therefrom to form said connector opening into a rectangular shape, and in which said first and second sections each have an end which is semi-circular in shape to form said cable insert end when first and second sections are formed into said housing; said cable insert end having a longitudinal axis which is parallel to said common plane.

12. A connector comprising:

first and second sections;

means enabling said first and second sections to be hinged together to form said housing;

said first and second sections being shaped to form a cable insert end and a connector opening when formed into said housing;

said first and second sections each having a securing area therein with aligned openings therein;

an electrical cable having a grounding sheath, said cable being inserted in said cable insert end;

a clamping band passing through said aligned openings and around said cable to secure said cable in said cable insert end and to also secure said first and second sections together when formed into said housing;

said first and second sections having an electrically conducting surface on an interior side thereof;

said securing areas of said first and second sections each having second aligned openings therein;

a second clamping band passing through said second aligned openings and around said grounding sheath to provide an electrical connection between said grounding sheath and said electrically conducting surface;

said first and second sections each having aligned recesses therein on opposed sides of said connector opening; and a connector operatively connected to said cable and having opposed mounting flanges which are received by said aligned recesses to provide a free floating connection with a mating connector.

13. The connector as claimed in claim 12 in which said housing has connection means thereon which are electrically connected with said electrically conductive surface to provide a grounding connection to a utilization device when said connector is operatively connected thereto.

14. The connector housing as claimed in claim 12 in which said connection means comprise:

connection lugs which are located on each of said first and second sections to enable said connector to be optionally secured to said utilization device or to a second connector having said mating conductor therein, which said second connector is identical to said connector.

15. The connector housing as claimed in claim 14 in which said securing areas of said first and second sections each have ribs therein to facilitate said electrical connection between said grounding sheath and said electrically conducting surface and to also secure said cable in said housing to prevent it from rotating with respect to said housing.

* * * * *